United States Patent [19]

Wolff

[11] Patent Number: 4,645,205

[45] Date of Patent: Feb. 24, 1987

[54] ATHLETIC EXERCISER FOR PARAPLEGICS AND QUADRIPLEGICS

[76] Inventor: Leslie C. Wolff, Box 188, Lakeview Dr., Hackensack, Minn. 56452

[21] Appl. No.: 752,960

[22] Filed: Jul. 8, 1985

[51] Int. Cl.[4] ..... A63B 21/00

[52] U.S. Cl. ..... 272/143; 272/130; 272/134; 272/DIG. 4

[58] Field of Search ..... 272/117, 123, 130, 134, 272/136, 143, 144, 145, DIG. 4, 116, 131, 125, 126, 142; 248/422; 128/25 R

[56] References Cited

U.S. PATENT DOCUMENTS

| | | | |
|---|---|---|---|
| 964,898 | 7/1910 | Budingen | 272/134 X |
| 2,831,687 | 4/1958 | Hunter | 272/145 |
| 3,128,094 | 4/1964 | Wolf | 272/130 |
| 4,171,802 | 10/1979 | Stoecker | 272/DIG. 4 X |
| 4,183,520 | 1/1980 | Chase | 272/130 |
| 4,235,437 | 11/1980 | Ruis et al. | 272/134 |
| 4,422,636 | 12/1983 | De Angeli | 272/DIG. 4 X |
| 4,465,274 | 8/1984 | Davenport | 272/130 |
| 4,492,375 | 1/1985 | Connelly | 272/134 |

FOREIGN PATENT DOCUMENTS

| | | | |
|---|---|---|---|
| 18311 | of 1889 | United Kingdom | 248/422 |
| 1153143 | 5/1969 | United Kingdom | 272/130 |

*Primary Examiner*—Richard J. Apley
*Assistant Examiner*—Robert W. Bahr
*Attorney, Agent, or Firm*—Keith T. Bleuer

[57] ABSTRACT

An athletic exerciser comprising a fixed support post having a support pipe telescoped in and rotatable in the support post and supporting a pair of exercise swing arms from its upper end. The swing arms have downwardly depending arm portions connected at their ends by handlebars. A bench is supported at its rear end with respect to the support post by means of a vertical pivot rod extending into a corresponding tube portion carried by the post so that the bench can be swung sidewardly or can be removed completely from the post by lifting the pivot rod out of the tube portion. The pipe carrying the swing arms on its upper ends has a portion extending sidewardly so that this portion can either extend forwardly of the exerciser toward the distal end of the bench or oppositely so that the pivot for the arms moves from over the forward end of the bench to a place spaced substantially rearwardly of the user whereby one of the handlebars moves essentially horizontally and the other of the handlebars moves essentially vertically when the pipe is swung to bring one or the other of the handlebars over the bench. A cushion is fixed on the support post at the rear end of the bench when in place for supporting the user when he straddles the bench facing forwardly. A hydraulic piston cylinder assembly carried at the upper end of the pipe restrains the swinging movement of the exercise arms.

10 Claims, 10 Drawing Figures

FIG. 2
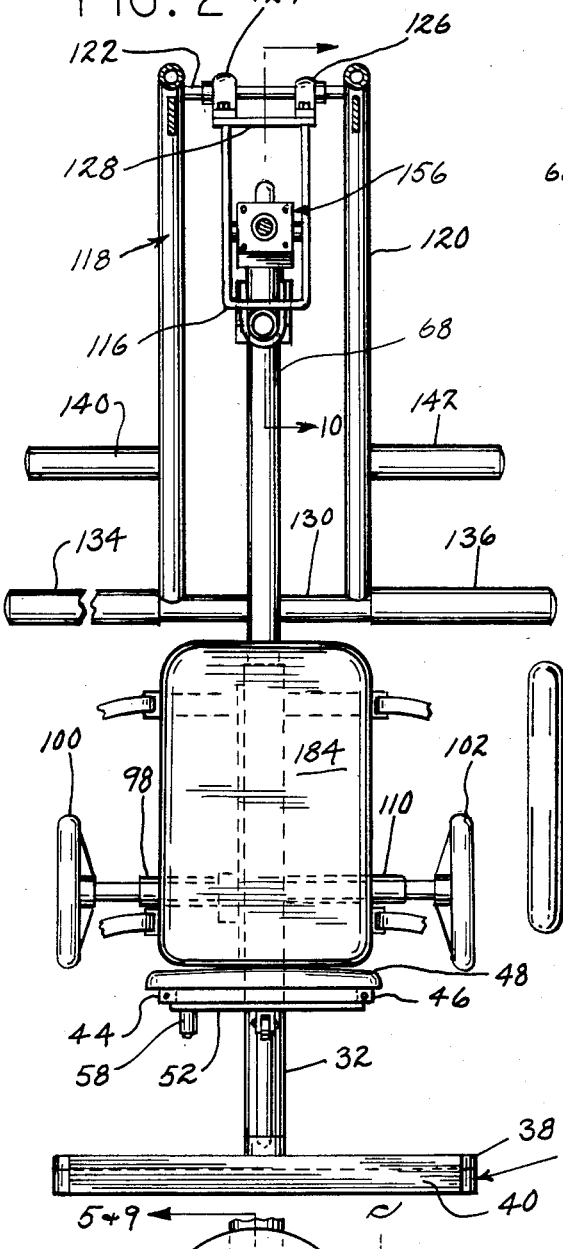
FIG. 4
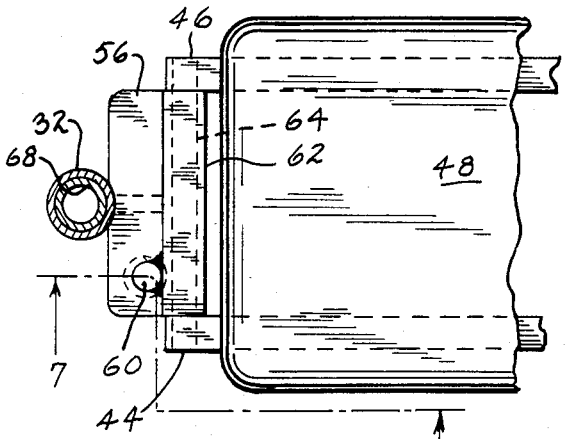
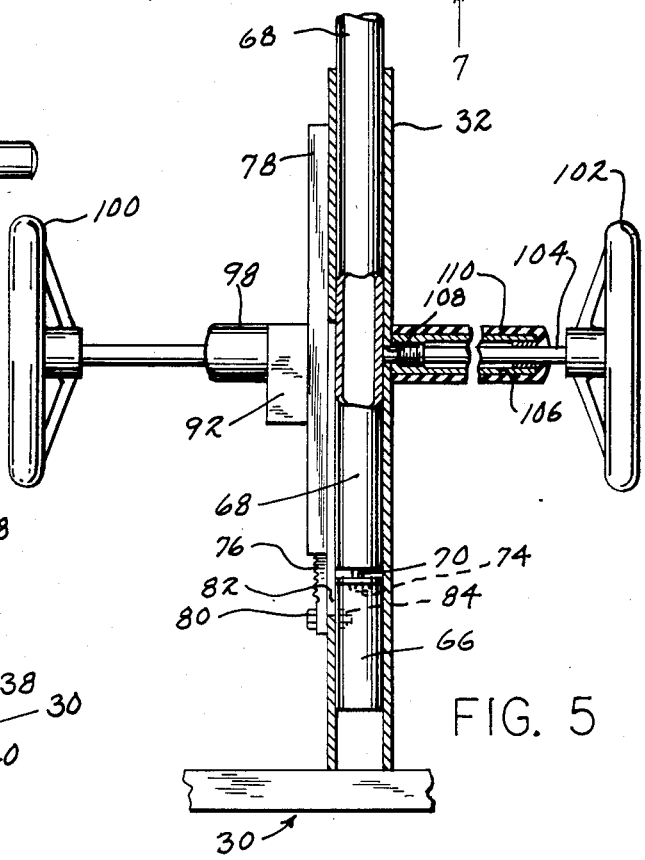
FIG. 5
FIG. 3
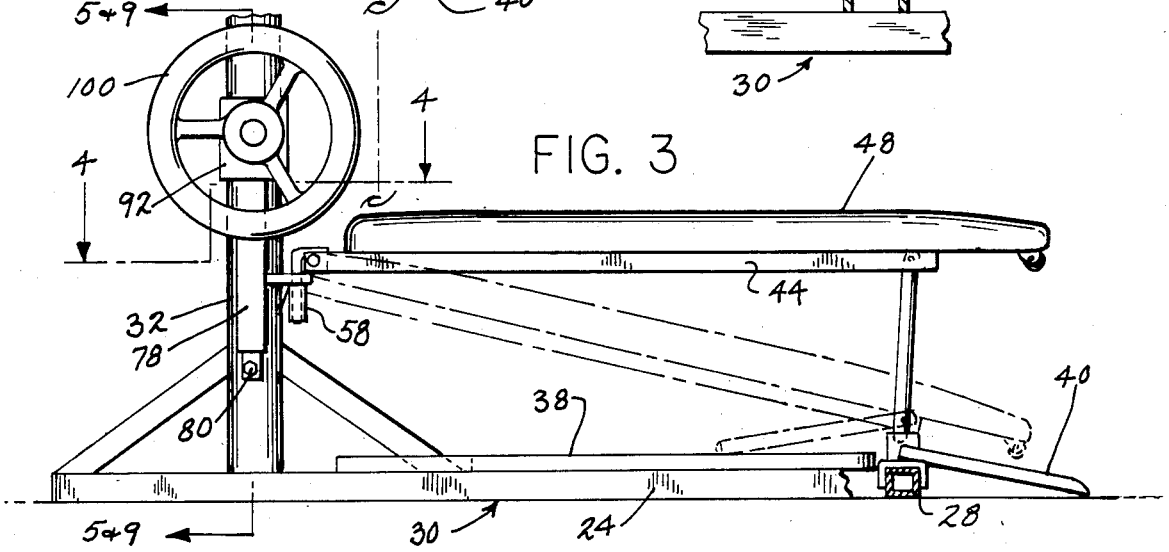

FIG. 7
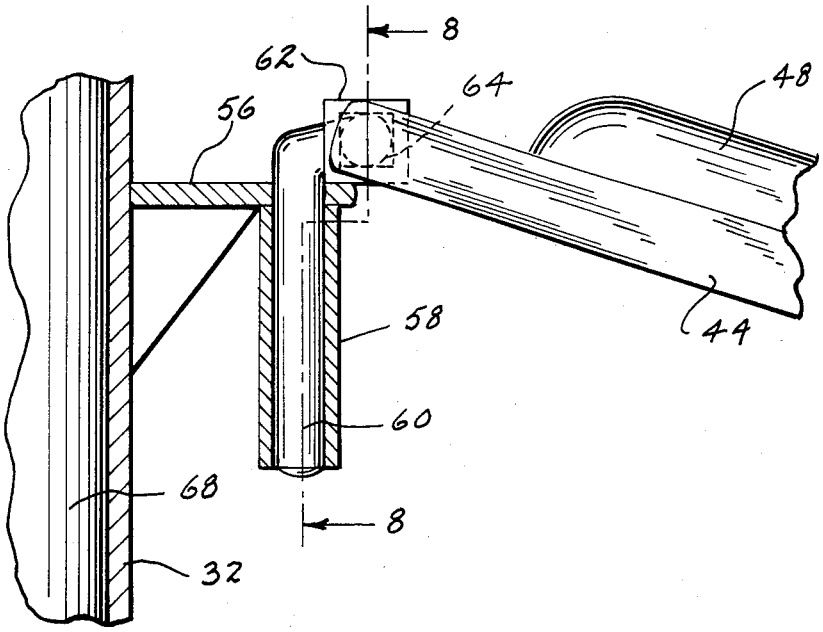
FIG. 8
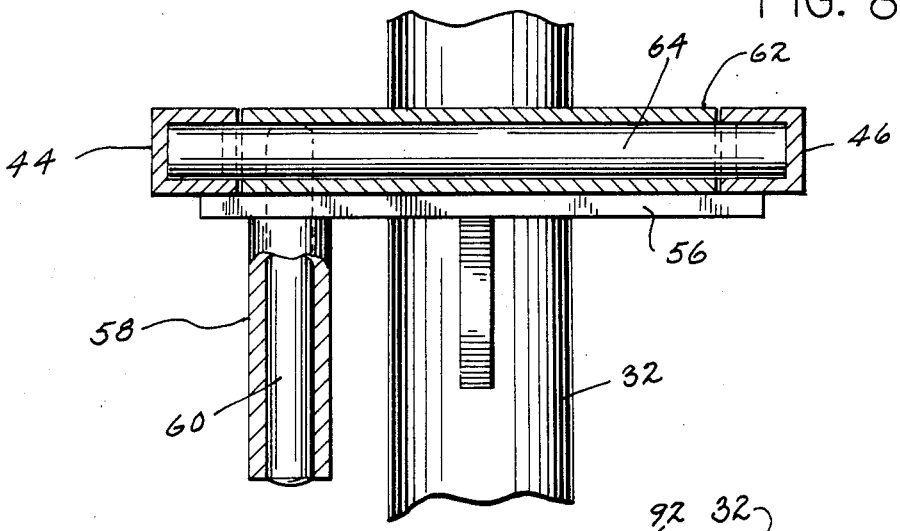
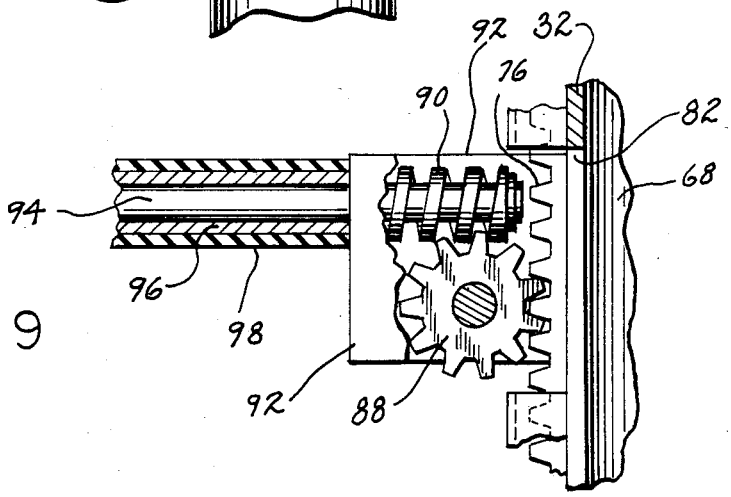
FIG. 9

ATHLETIC EXERCISER FOR PARAPLEGICS AND QUADRIPLEGICS

CROSS REFERENCES TO RELATED APPLICATIONS

This application is related to my co-pending application entitled "Athletic Exerciser," Ser. No. 554,820, filed Nov. 23, 1983.

BACKGROUND OF THE INVENTION

The invention relates to athletic exercise equipment particularly of such construction and adaptation that it is particularly suitable for usage by paraplegics and quadriplegics.

In recent years, interest in physical fitness has increased dramatically spawning an explosion of new exercise equipment for the gymnasium and in particular for the home. Multi-purpose home gyms of many styles and degrees are now on the market purporting to enable the user to do exercises for all areas of the body.

This great interest in exercise and fitness has recently overflowed to include the physically "handicapped." Until federal agencies stepped in and began mandating accessibility of facilities, few people were aware of the physical capabilities that many of the so-called "handicapped" possess and the great help to these people from the proper exercise. Most facilities were not accessible to people confined to wheelchairs so of course these individuals did not use them and did not obtain the benefits of proper exercise. With the increasing public awareness of the benefits for such handicapped people, within the past few years wheelchair basketball has been used for providing exercise for those bound to wheelchairs; and, in addition, there have been a few, very expensive, highly specialized pieces of exercise equipment designed for wheelchair-bound people.

The athletic exerciser disclosed in my co-pending application, Ser. No. 554,820, is a good apparatus for the general population and includes a pivoted arm that is raised against the action of a hydraulic piston; however, this athletic exerciser is not particularly adapted for wheelchair-bound people.

SUMMARY OF THE INVENTION

It is an object of the present invention to provide an improved exerciser which is particularly suitable for wheelchair-bound people and more particularly suitable for paraplegics and quadriplegics, providing the proper exercises for these people.

I have found that paraplegics and quadriplegics in addition to other handicapped people afflicted with arthritis, cerebral palsy, multiple sclerosis, stroke, etc., should have handles or the like constrained for movement in either the horizontal direction for certain exercises or else in the vertical direction for other exercises and with the movements being restrained so that the person exercising must use his muscles in moving the handles. This has been accomplished with the present exerciser by providing a head assembly adjustable rotatably with respect to a lower bench assembly, with the head assembly carrying exercise arms in opposite directions from a pivot shaft carried by the head assembly. The exercise arms are swingably mounted by means of a pivot shaft carried by the head assembly, and this shaft may be alternately moved from above the person using the exerciser to a position substantially behind him so that handles on one end of the exercise arms move substantially horizontally, while the handles on the other ends move substantially vertically. A hydraulic piston-cylinder assembly effective in both directions is provided for restraining the swinging movement of the exercise arms and handles so that the proper restraint is available to exercise the user's muscles.

BRIEF DESCRIPTION OF THE DRAWINGS

FIG. 2 is a front elevational view of the exerciser and taken from line 2—2 of FIG. 1;

FIG. 3 is a side elevational view of the lower portion of the exerciser;

FIG. 4 is a fragmentary sectional view of the exerciser taken from line 4—4 of FIG. 3;

FIG. 5 is a fragmentary sectional view of the main support post or tube of the exerciser and associated structure and taken on line 5—5 of FIG. 3;

FIG. 7 is a fragmentary sectional view on an enlarged scale of the support for the rear end of the bench and taken on line 7—7 of FIG. 4;

FIG. 8 is a sectional view taken on line 8—8 of FIG. 7;

FIG. 9 is a fragmentary sectional view taken on line 9—9 (the same line on which FIG. 5 is taken) of FIG. 3 and showing various internal parts not revealed in FIG. 5.

DESCRIPTION OF THE PREFERRED EMBODIMENT

Figure 1:
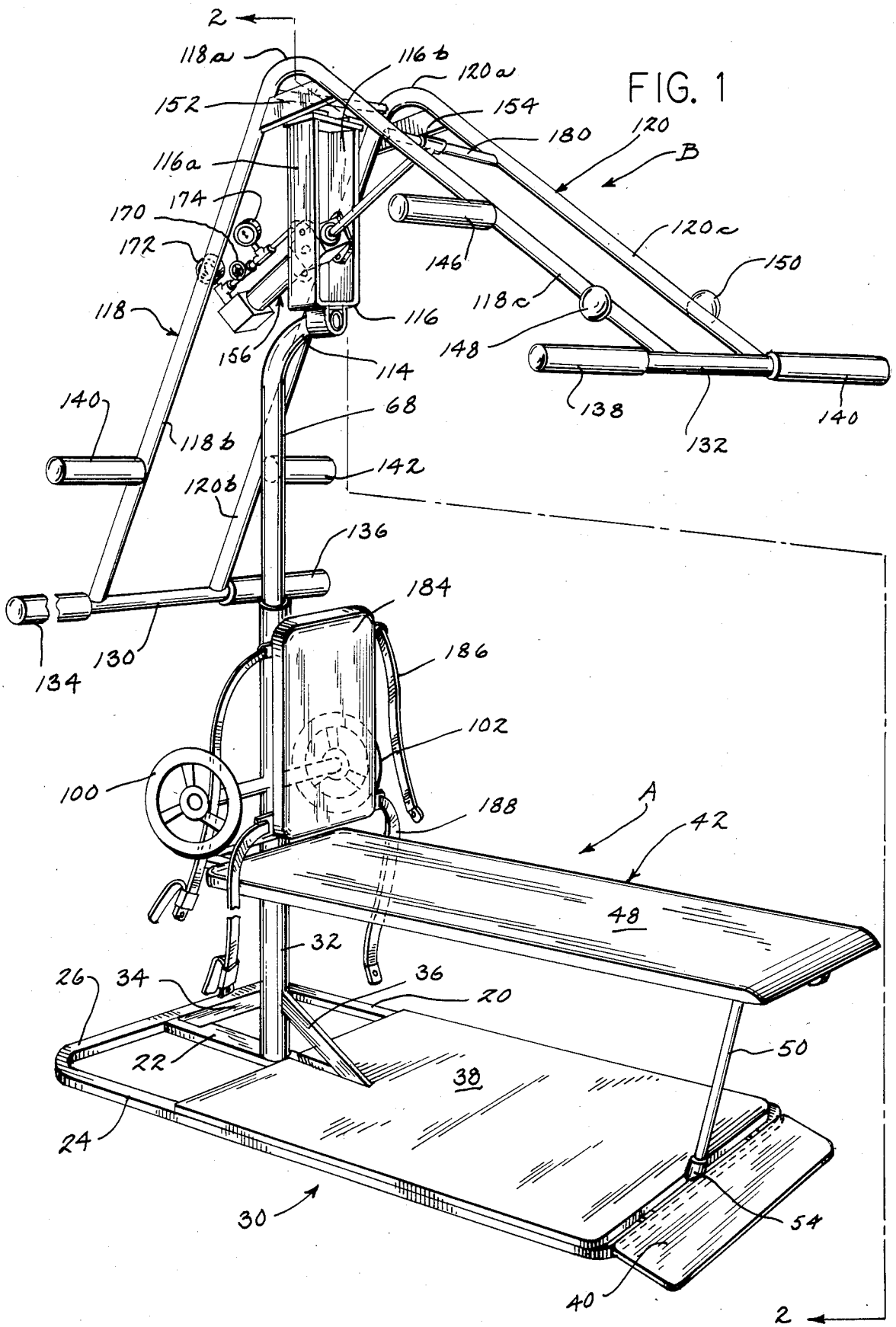
FIG. 1 is a perspective view of the exerciser of the invention which includes a lower bench and frame assembly and an upper head and cylinder assembly supported by the bench and frame assembly.

Referring now to FIG. 1, in particular, the illustrated exerciser may be seen to comprise a lower bench and frame assembly A and an upper head and cylinder assembly B which is supported by the assembly A. The assembly A may be seen to comprise three parallel, relatively long bars 20, 22, and 24 connected at their ends by a pair of relatively short bars 26 and 28 (See FIG. 3 also). These bars are all fixed with respect to each other and together form a co-planar bottom support or ground supported base 30 that is adapted to rest on a flat surface, such as a floor, with all of the bars in contact with the flat surface. An upstanding support post or tube 32 is fixed as by welding to the bar 22 at right angles to the bar 22 and is braced with respect to the bar 22 by means of braces 34 and 36 that are welded to the tube 32 and to the bar 22. A platform 38 is disposed on top of the bars 20, 22 and 24 as shown in FIG. 1 and is fixed to these bars in any suitable manner. A downwardly depending apron 40 rests at its upper end on the bar 28 and rests at its lower end on the flat surface supporting the base 30.

A bench 42 is pivotally mounted with respect to the tube 32 and comprises two parallel, relatively long bars 44 and 46 (See FIG. 2). The bars 44 and 46 are connected together at their ends distal with respect to the pivotal mounting of the bench (which may be termed their forward ends) and extend parallel with respect to the bars 20, 22 and 24 and support an elongated seat pad 48. A support bar or prop 50 is pivotally mounted on the forward end of the bench 42 by means of a pivot rod 52

(see FIG. 2) that extends into both of the bars 44 and 46, and an upstanding insert tube 54 is welded to the bar 28 for receiving the lower end of the prop 50 when the bench 42 is in upraised position for supporting the distal end of the bench 42.

The near end of the bench 42 adjacent to the tube 32 is supported with respect to the tube 32 by means of a bracket 56 that is welded to the tube 32. The bracket 56 has a downwardly extending tube portion 58, and a pivot rod 60 extends through an opening in the bracket 56 and through the tube portion 58. A case 62 is fixed on the upper end of the rod 60, and a pivot rod 64 extends through the case 62. The rod 64 extends into the two bars 44 and 46 as shown in FIG. 8. The pivot rods 60 and 64 provide the pivotal mounting of the bench with respect to the post 32, with the pivot rod 64 allowing the bench 42 to te declined with a removal of the prop 50, and the pivot rod 60 allowing the bench 42 to be swung sidewardly, as will be hereinafter more fully described.

Figure 6:
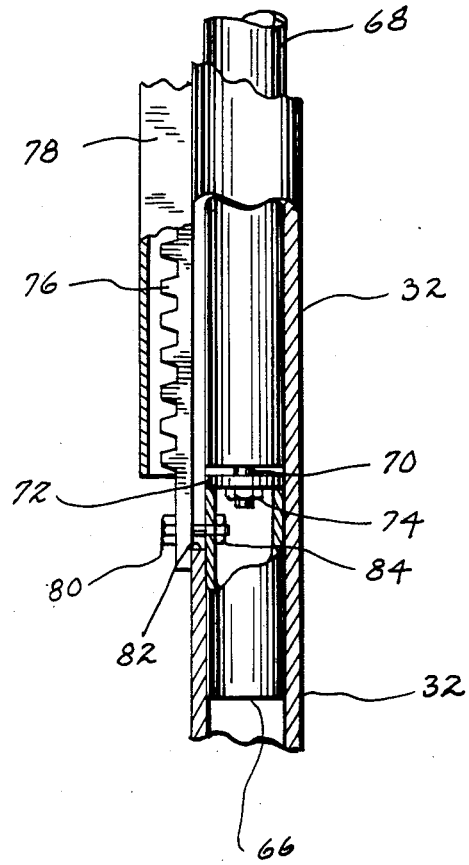
FIG. 6 is a view similar to FIG. 5 but of a smaller portion of the main post and on an enlarged scale.

Pipes 66 and 68 are slidably disposed within the tube 32 (See FIGS. 5 and 6). A bolt 70 is fixed in the lower end of the pipe 68 and extends through a central opening in a plate 72 fixed on the upper end of the pipe 66. A nut 74 is disposed on the bolt 70 and holds pipes 66 and 68 from separating.

A rack gear 76 is slidably disposed on the outer surface of the tube 32 and is located within a gear guard 78 on the outer surface of the tute 32. A bolt 80 connects the rack gear 76 with the pipe 66 and extends through a slot 82 formed in the tube 32. A nut 84 fixes the bolt 80 with respect to the pipe 66. A pinion gear 88 (see FIG. 9) is in mesh with the rack gear 76, and a worm gear 90 is also in mesh with the pinion gear 88. Both of the gears 88 and 90 are rotatably mounted in a gear casing 92 that is fixed on the side of the tube 32. The worm gear 90 is on the end of a drive shaft 94 that extends through a tube 96 that is fixed on the side of the casing 92. A tube 98 of rubber-like material is disposed about the tube 96. A hand wheel 100 is fixed on the end of the shaft 94 for manually rotating the worm gear 90 for purposes to be described.

A hand wheel 102 (see FIG. 5) similar in size and shape to the hand wheel 100 is fixed on the end of a screw or bolt 104 that has a screw threaded relationship with a tube 106 that is fixed on the tube 32. The end of the bolt 104 extends through an opening 108 in the tube 32 for tightening the pipe 68 with respect to the tube 32 for purposes to be described. A tube 110 of rubber-like material is disposed about the tube 106. It will be observed from FIGS. 1, 2 and 5 that the rubber-like tubes 98 and 110 and thus the supporting tubes 106 and 96 are in coaxial alignment on opposite sides of the tube 32.

The pipe 68 extends out of the upper end of the tube 32 and has a bend 112 of about 70 degrees on its upper end providing a pipe portion 114 that extends mostly horizontally in the general direction of the bars 20, 22, and 24 as the exerciser is shown in FIG. 1. A U-shaped support member 116 is fixed on the pipe portion 114 so as to have its two legs **116*a* and 116*b* (see FIGS. 1 and 10) extending vertically and upwardly. Exercise arms 118 and 120, which extend parallel to each other and are similar in shape, are swingably disposed with respect to the support member 116 by means of a horizontal pivot shaft 122 fixed to and connecting the arms 118 and 120. The shaft 122 extends through and is supported by a pair of bearings 124 and 126 (see FIG. 2) that are in turn disposed on a horizontal plate 128 which is fixed on the upper ends of the support member legs 116*a* and 116*b***.

A handlebar 130 connects adjacent distal ends of the arms 118 and 120, and a handlebar 132 connects the other distal ends of the arms 118 and 120 together. It will be observed that the bars 130 and 132 extend beyond the exercise arms 118 and 120 and rubber hand grips 134, 136, 138 and 140 are respectively provided on these extensions of the arms 130 and 132. Opposite coaxially disposed handlebars 140 and 142 are also provided on the exercise arms 118 and 120 and are located closer to the pivot shaft 122 than are the grips 134 and 136, and a single handlebar 146 is provided on the arm 118 which is located about the same distance from the pivot shaft 122 as are the handlebars 140 and 142. A pair of ball hand grips 148 and 150 are provided opposite each other on the exercise arms 118 and 120 and as shown in FIG. 1 are located somewhat adjacent to the handlebar 132.

Figure 10:
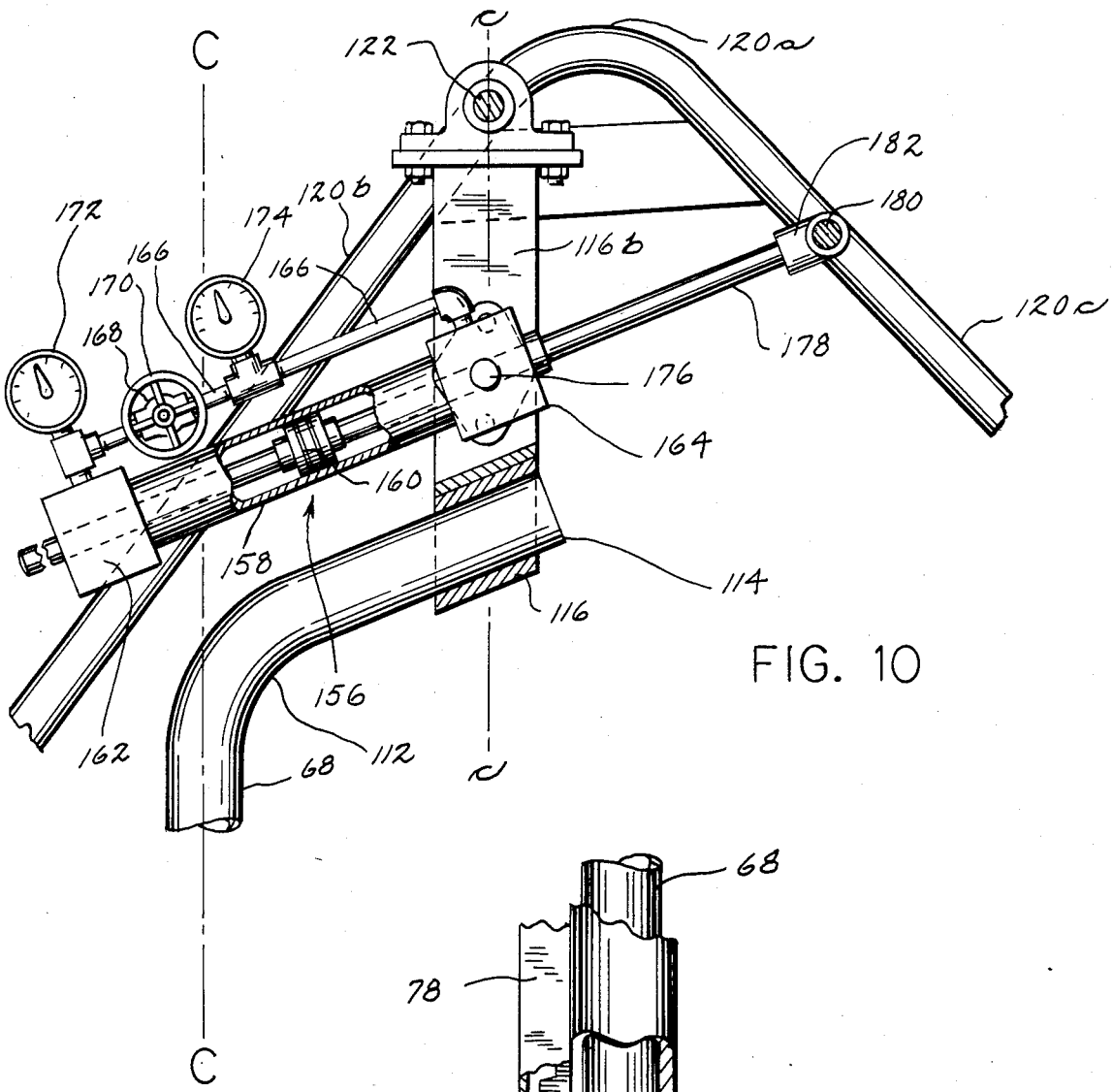
FIG. 10 is a fragmentary sectional view on an enlarged scale taken on line 10—10 of FIG. 2.

The arms 118 and 120 have bends **118*a* and 120*a* in them of slightly more than 90 degrees so that the arm portions 118*b* and 118*c* extend at this angle of slightly more than 90 degrees with respect to each other; and the same is true of the arm portions 120*b* and 120*c*. The arms 118 and 120 are straight except for the bends 118*a* and 120*a*. Referring to FIG. 10, it will be observed that the pivot shaft 122 is fixed to the exercise arm portion 120*b* adjacent to the bend 120*a* and between the bend 120*a* and the handlebar 130 on the end of the exercise arm portion 120*b*. Likewise, the pivot shaft 122 is fixed to the arm portion 118*b* adjacent to the bend 118*a* and between the bend 118*a* and the end of the arm 118*b* on which the handlebar 130 is mounted. A brace 152 extends between the exercise arm portions 118*b* and 118*c* and is fixed with respect to both of these exercise arm portions. A similar brace 154 extends between and is fixed with respect to the arm portions 120*b* and 120*c***.

A hydraulic piston-cylinder assembly 156 is swingably mounted between the arms **116*a* and 116*b* of the support member 116. The assembly 156 comprises a hollow tube 158 providing a cylinder with a piston 160 slidably disposed therein. The tube 158 has closures or heads 162 and 164 on its opposite ends, and a hydraulic bypass tube 166 has its ends connected to the heads 162 and 164. A throttle valve 168 is in the tube 166 and is controlled by means of a relatively large hand wheel 170. The valve 168 is a simple valve which provides the same impediment to fluid flow for both directions of flow. Pressure gauges 172 and 174 are provided in the tube 166 at opposite sides of the valve 168. The head 164 is swingably mounted between the opposite arms 116*a* and 116*b* of the support member 116 by means of opposite pins 176** which provide a horizontal swing axis.

A piston rod 178 extends through the head 164 and through the tube 158, having the piston 160 fixed on it. The remote end of the rod 178 is swingably mounted with respect to the arm portions **118*c* and 120*c* by means of a rod 180 connecting the arm portions 118*c* and 120*c* and a T fitting 182 extending around the rod 180 and having the piston rod 178 screw threaded into it. The tubes 158 and 160** are filled with a suitable fluid such as oil.

A back cushion 184 is fixed in any suitable manner to the tube 32 just above the pivotal connection of the bench 42 with the tube 32 by means of the pivot rod 64, and a pair of holding straps 186 and 188 for the user of the apparatus are provided adjacent to the upper and lower edges of the cushion 184.

Although the exerciser is valuable for use by able-bodied people, it is particularly valuable for paraplegics and quadriplegics who have limited shoulder flexibility making it very difficult for them to work the tricep and bicep muscles. The exerciser is particularly valuable for these disabled people, since it has the handle 132 which moves essentially horizontally and the handle 130 which moves essentially vertically. This is due to the positioning of the pivot shaft 122 and its vertical center line c—c forwardly of the center line C—C of the support tube 32 (toward the forward, distal ends of the platform 38 and bench 42 and toward the apron 40) when the handlebar 132 is used, while the pivot shaft 122 and its center line c—c are positioned on the other side of the center line C—C when the handlebar 130 is used. The same movements occur for the ball grips 148 and 150 as for the handlebar 132, and the same movements occur for the handlebars 140 and 142 as for the handlebar 130.

A paraplegic or quadriplegic may be considered to be in a wheelchair when exercising and for this purpose he has the bench 42 removed. This may be accomplished by a helper who simply pulls the bench 42 upwardly so as to pull the pivot rod 60 out of the tube 58 so that the bench is free of the rest of the machine and may be positioned to the side. Alternately, the bench 42 may be swung to the side, with the rod 60 remaining in the tube 58 and allowing the bench 42 to be pivoted about the tube 58. With the bench being out of the way, the person backs his wheelchair onto the platform 38 (which may be said to constitute an exercise area) over the apron 40 so that the back of his wheelchair is against the cushion 184. He then preferably ties himself in place using the straps 186 and 188. It is assumed that the bar 132 is in front of the person and if the elevation of the bar 132 is too low or too high, the person reaches back of himself and turns the hand wheel 100 in one direction or the other. The hand wheel 100 acting through the shaft 94 turns the worm gear 90 and thus the pinion gear 88 and rack gear 76. The rack gear 76 is tied to the pipe 66 (which is movable vertically in the pipe 32 but it does not rotate), and the pipe 66 moves the pipe 68 supporting the arms 118 and 120 by means of the support member 116 and the shaft 122 up or down. It has been assumed that the screw 104 is released with respect to the pipe 68, and the person exercising reaches behind himself on the other side and tightens the screw 104 with respect to the pipe 68 thus assuring that it remains in its adjusted position.

Two exercises that may be accomplished by the person in the wheelchair are the chest press exercise and the row exercise. For these exercises, the pipe 68 is in its rotative position as shown in FIG. 1, with the transversely extending pipe position 114 extending forwardly (toward the distal end of the platform 38 and toward the ramp 40). Under these conditions, the pivot shaft 122 is directly over the head of the person in the wheelchair, and the vertical center line c—c passes through the head of the person in the wheelchair. The handlebar 132 under these conditions is directly in front of the person in the wheelchair with the handlebar 132 being adjusted along with the arms 118 and 120 so that the handlebar 132 is at a level slightly below the person's chin. For the chest press exercise, the person pushes against the handlebar 132 using the hand grips 138 and 140, and the primary muscles exercised are the pectoralis major, while the secondary muscles exercised are the deltoid and triceps. After the pushing effort by the person, he pulls the handlebar 132 back toward himself and thus does the row exercise. The primary muscles exercised in the row exercise are the latissimus dorsi, teres major and teres minor. The secondary muscles exercised are the trapezius. As has been explained, when the handlebar 132 is used, it moves essentially horizontally, since the pivot rod 122 and its vertical center line c—c are in front of the center line C—C. The swinging movement of the arms 118 and 120 is restrained by the piston 160 moving in the tube 158 and thus causing fluid in the cylinder to flow through the pipe 166 in one direction or the other, with the fluid flow being restricted by the valve 168, the same for both directions of fluid flow. The tube 158 swings slightly about the pins 176 as the piston 160 moves in the tube 158, since the rod 178 is rigid. If the restraint is too much or too little for the exercise desired, the person in the wheelchair may reach up and adjust the valve 168 using the hand wheel 170. If desired, he may have the pressure measured and noted using the gauges 172 and 174. For these exercises, preferably the elbows are out, and the person exercising maintains a wide grip on the hand grips 138 and 140.

Other exercises that the person in the wheelchair may accomplish, with the pipe portion 114 extending forwardly (in the direction toward the ramp 40) are the curl exercise and the tricep extensor exercise. For these exercises, the ball grips 148 and 150 are used; and the pipe 68 is adjusted vertically so that the bar 132 is about at chest level. As for other adjusted positions of the pipe 68, the height is changed using the wheel 100, while the pipe 68 is subsequently held in the desired adjusted position using the hand wheel 102. For these two exercises, the elbows are held in, and the grips 148 and 150 are pulled back for the curl exercise and are subsequently pushed away from the user for the tricep extensor exercise. For the curl exercise, the palms of the hands are in front of the ball grips 148 and 150 from the bottom, while the palms of the hands are in back of the grips 148 and 150 from the top for the tricep extensor exercise. The ball grips provide the facility of a quick rotation of the palms with movement of the hands from underneath the grips to positions over the grips and vice versa, with the palms moving over the outer surfaces of the grips as changes are made from pulling to pushing and vice versa in these two exercises. As with the other exercises, the piston 160 restrains the movement of the arms 118 and 120, so that the muscles must overcome the restraint of the piston. In the curl exercise, the primary muscles exercised are the biceps, brachi oradialis and flexor carpi. The secondary muscles exercised are the deltoid. In the tricep extensor exercise, the primary muscles exercised are the triceps, and the secondary muscles exercised are the deltoid.

The pipe 68 is rotated for 180 degrees for the incline press and the low latissimus row exercises, so that the transversely extending portion 114 of the pipe 68 extends rearwardly (away from the distal end of the platform 38 and from the ramp 40). The bar 130 in this case is in front of the person in the wheelchair, and the height of the pipe 68 is such that the bar 130 is just below the chin of the person exercising. The person has his hands on the handlebars 134 and 136 and grasps the bars from and over the top. He pushes upwardly for the incline press exercise and subsequently pulls down for the low latissimus row exercise. In the incline press exercise, the primary muscles exercised are the upper pectoralis major and the deltoid, while the secondary muscles exercised are the triceps and trapezius. In the low latissimus row exercise, the primary muscles exercised are the lower back muscles.

The person in the wheelchair may do overhead press and lat pulldown exercises with the transversely extending pipe portion 114 continuing to remain extending rearwardly (in the direction away from the ramp 40). The height of the pipe 68 remains about as before with the incline press and low latissimus row exercises, but in this case the user uses the higher handles 140 and 142. Keeping his elbows out, he pushes upwardly for the overhead press exercise and subsequently pulls downwardly for the lat pulldown exercise. In the overhead press exercise, the primary muscles exercised are the deltoid and trapezius, and the secondary muscles exercised are the triceps and pectoralis major. In the lat pulldown exercise, the primary muscles exercised are the latissimus dorsi, and the secondary muscles exercised are the teres major and teres minor.

For a side to side shoulder stretch exercise, the pipe 68 is rotated to a rotative position just between the two positions just mentioned so that the transversely extending pipe portion 114 extends sidewardly to the left of the user who faces forwardly. The left one of the person's hands grasps the handle 146, and the right hand grasps the handle 140. The handles 140 and 146 are so positioned on the exercise arms 118 and 120 so that the handles 140 and 146 are about at the same height, and the person alternately pulls the handles 140 and 146 downwardly, so that each hand alternately moves up and down. The primary muscles exercised are the trapezius, deltoid, latissimus dorsi and triceps.

The exercising apparatus also is very useful for able-bodied people as well as those who are only partially incapacitated and may sit on the bench 42. For a stretching exercise, the person sits on the bench facing forwardly (in the direction toward the ramp 40), and he alternately pushes the handle 132 forwardly and then pulls it back. His hands in this case are on the handles 138 and 140. For this exercise, the pipe portion 114 extends forwardly as shown in FIG. 1. For a squat/toe raise exercise, the pipe 68 is turned through 180 degrees so that the pipe portion 114 extends in the opposite direction (away from the ramp 40), and the prop 50 is removed so that the bench declines from the rod 64. The person exercising straddles the bench 42 with his feet and alternately squats and raises upwardly on his toes.

For a body lift or sit up exercise, the bench 42 is allowed to decline with the prop 50 being removed and with the rear end of the bench 42 being supported by the pivot rod 64. The person exercising places his feet beneath the rubber tubes 98 and 110, with the tubes 96 and 106 providing support; and he then alternately sits up and leans back on the declining bench 42 so as to exercise himself at the waist. For a leg lift exercise, the body is reversed on the declining bench 42 and the hands grip the tubes 98 and 110, and he then alternately raises his knees and feet and allows them to return to prone position.

Advantageously, the exerciser of the invention provides resistance by means of a standard hydraulic cylinder. The hydraulic cylinder is capable of infinite resistance settings, by opening or closing the valve 168, so as to thereby control the flow of fluid from one end of the tube or cylinder 158 to the other. By exerting, pushing or pulling, against the sets of specially designed handles 134, 136, 140, 142, 148, 150, 138 and 140, resisted by the hydraulic means, an individual avoids the danger associated with common constant resistance devices such as weights, springs, rubber bands or body weight. Such common constant resistance devices provide the danger that the device must be constantly controlled from the start of motion until its completion, which is difficult. The use of hydraulics as in the present apparatus, uses the isokinetic principles of training, whereby the resistance accommodates to the user's capabilities. When the valve 168 is set at a predetermined speed/resistance setting, the user will receive resistance in direct proportion to the effort he or the is capable of exerting. If a strong effort is applied onto the handles, the hydraulics resists equally strongly. If the push and pulling force is easy, the resistance by the hydraulics will be easy. Everyone is capable of exerting a varying amount of force at different stages of an exercise's range of motion, so the hydraulic resistance provided by the present apparatus is advantageous. This varying force occurs naturally in all exercise movements because of bone levers and muscle attachments. For example, in arm or leg extension exercises, a person is capable of exerting more force as the arm or leg nears full extension; and this fact is often more pronounced with someone who has suffered a debilitating illness such as arthritis or an injury such as a spinal cord paraplegic.

The hydraulics allows the user to ease through a short range of the exercise movement where force may be limited by pain or physical weak spots. As the user moves into a range of the exercise where he or she is capable of exerting more force, the hydraulics automatically accommodates to offer more resistance. By using the double-acting piston 160, a resistance is offered both as a pushing and a pulling occurs, allowing two opposite sets of muscle groups to be exercised at one time. Another benefit of such a construction is the heart and lung stimulation derived especially with a light resistance setting and rapid repetition of the push and subsequent pull movements. The double action of the piston 160 allows a person to get a great heart-lung workout, since the resistance using the valve 168 can be set very light allowing numerous repetitions of the exercise with resistance at each stage of movement. This may be contrasted with weight exercising machines with the only substantial effort produced by starting a weight in motion. The double action of the piston 160 also allows repetitions to be done involving two opposing sets of muscles, so that heart-lung interaction can be increased greatly without an overtiring of one set of muscles.

The arrangement of the present exerciser in which the bar 132 moves essentially horizontally is considered particularly valuable for paraplegics and quadriplegics who generally have limited shoulder flexibility which makes it very difficult for them to work the tricep and bicep muscles in an overhead movement. The curl and tricep extensor exercises using the ball grips 148 and 150 which also, like the bar 132, move essentially horizontally are thus considered particularly valuable for these people. Most quadriplegics have damaged nerves operating the tricep muscles which often limits severely their use of these muscles to push the palms and forearms away from the body and a tricep push exercise overhead is thus not merely awkward but possibly impossible for them; hence, the tricep extensor and curl exercises previously described use the ball grips 148 and 150 which move essentially horizontally.

The ball hand grips 148 and 150 which are used in the curl and tricep extensor exercises enable the tricep and bicep muscles to be worked by pushing out with the palms for the tricep muscles and by rotating the palms and pulling back with the palms for the bicep muscles. As previously mentioned, for the curl exercise, the hands are positioned over the ball grips 148 and 150 from the bottom, while the hands are positioned over the ball grips from the top for the tricep extensor exercise. The ball grips 148 and 150 allow quick rotation of the palms between these positions so that these two exercises can take place alternately.

It may be noted that many quadriplegics lose control of the finger nerves which limits severely the grip in their hands. This loss of grip does not affect exercise using the bar 132 as with the chest press and row exercises previously mentioned, since the palms are used to push the bar 132 and a special strapped mitt can be used to encircle each of the handles 138 and 140 for the row pulling exercise. Such mitts allow a bar to be pulled back without actually gripping it.

The second sets of handles 134, 136, 140 and 142 which are used when the pipe 68 is rotated 180 degrees, allow the overhead press, lat pulldown, incline press and low lat row exercises to be accomplished. In performing the overhead press exercise, the elbows are out from the body which brings into play the shoulder muscles. Incidentally, in all exercises, the positions of the elbows are important as to which muscles receive the most exercise. Generally when the elbows are held in close to the body, the arms are affected more; while if the elbows are held out, the shoulder or chest muscles are affected more.

As is apparent, the bar 132 has an essentially horizontal movement, while the bar 130 has an essentially vertical movement due to the positioning of the pivot rod 122 farther from the handle 132 than the handle 130. The bends 118*a* and 120*a* in the arms 118 and 120 have the important function of positioning the bar 132 more directly in front of the person exercising, and this is also due to the offset of the pivot shaft 122 from center line C—C of the main support pipe 68. It may be noted that the trunk of the person exercising when using the handle 132 or grips 148 and 150 is nearly substantially beneath the pivot shaft 122 so when the handles 138, 140, 148 and 150 are used, the bar portions 118*c* and 120*c* depend downwardly nearly vertically in front of the person exercising.

Preferably the bench 42 is close to the same height as a wheelchair. Therefore, some of the more active paraplegics may use the exercise apparatus with the bench 42 installed, transferring from wheelchair to bench 42. The exercising apparatus can therefore accommodate all degrees of physically disabled people. When the bench 42 is swung out of the way or completely removed, a wheelchair can simply be backed over the apron 40 onto the platform 38 prior to positioning the back of the wheelchair in contact with the cushion 184 and then fastening the belts 186 and 188 around the person on the wheelchair. The proper height of the pipe 68 and thus of the pivot shaft 122 can easily be obtained with the person remaining in seated position on the wheelchair by using the press/row handles 134 and 136, for example. If the handles 134 and 136 are adjusted (using the hand wheel 100) so that these handles are approximately two inches below armpits, this assures that all of the handles will be at proper height.

Cerebral palsied, the elderly, those recuperating from accident or illness or able-bodied people are all able to use the exerciser, since there is very little movement or strength required to position or use the apparatus (except for removing the bench which may be accomplished using help). No part of the exercise apparatus requires physical support at any time making it entirely safe for even the most severely handicapped. By using a cuffed glove (readily available), the bar exercises (those using the handles 134, 136, 140, 142, 146, 138 and 140) can be done by individuals who have virtually no grip strength; pushing may be done with the person's palms and pulling may be done with the palms or with a glove strapped or wrapped around the handle.

The exercising apparatus is so designed that anyone can operate it totally by himself except in the case of those so severely handicapped that they are virtually incapable of any arm movement. The bench 42 is designed so that even a higher level quadriplegic with limited arm use can lift the prop 50 and swing the bench 42 out of the way using his electric wheelchair. The height adjustment wheel 100 and set screw wheel 102 are within easy reach situated only a few inches behind the position of a person's wheelchair wheels when the chair is backed onto the platform 38 and with the wheelchair being in contact with the cushion 184. The valve control wheel 170 is also within easy reach of the person in the wheelchair for adjusting the resistance to movement of the arms 118 and 120.

The pivot rod 60, which is relatively short, easily slides out of the tube portion 58 for removal of the bench 42 if this is desired. For return of the bench, the arrangement of the pivot rod 60 fitting in the tube portion 58 only requires lining up one hole rather than more. For most uses, it is not necessary to actually remove the bench 42; instead, the bench 42 may simple be swung out of the way of a wheelchair to be backed onto the platform 38. When the set bolt 104 is disengaged with respect to the pipe 68, the arm handle arrangement including the exercise arms 118 and 120 may be swung easily from side to side. Since the wheel 170 is relatively large, this allows for adjustment of the valve 168 even though the nerves controlling finger dexterity and grip may have been damaged.

I have discovered that paraplegics and quadriplegics, for proper exercise, should have a restrained motion both vertically and horizontally. The exerciser of the present invention provides this by alternately placing the pivot shaft 122 for the exercise arms 118 and 120 either substantially directly over the head of the user with the vertical center line c—c passing through his trunk or else with these substantially spaced backwardly. The shaft 122 in the first position is substantially over the head of the user, whether he is in a wheelchair that is against the cushion 184 or whether he is on the bench 42 with his back being against the cushion 184, when the pipe 68 is rotatably adjusted so that its portion 114 extends forwardly, in the direction toward the ramp 40. In this case, the hand grips 138, 140, 148 and 150 being used move substantially horizontally. When the pipe 68 is turned in the opposite direction, through 180 degrees, the hand grips 134, 136, 140, and 142 move substantially vertically, since the pivot shaft 122 and its center line c—c in this case are on the other side of the center line C—C, with the pipe portion 114 extending rearwardly, in the direction away from the ramp 40.

I claim:

1. Athletic exercise apparatus comprising a ground-supported base and a stationary upstanding post carried by and extending upwardly from said base, means defining an exercise area forwardly of and adjoining said post, an exercise arm, means supported by said post and providing a pivot for said arm having its axis extending in a direction transverse with respect to the longitudinal axis of said post so that said arm may swing over said exercise area and is supported by said post, means restraining the swinging movement of said arm to provide exercise for the user when he moves said arm against said restraining means, and means for selectively adjusting the position of said pivot either backwardly away from or forwardly toward said exercise area so that said arm moves selectively more horizontally or more vertically over said exercise area during its exercising swinging movement, said arm including two arm portions on opposite sides of said pivot, said means for selectively adjusting the position of said pivot as aforeside including an elongate rod journaled in said post and having a sidewardly extending part on its upper end with said pivot being supported by said sideway extending part whereby said pivot may be moved as aforesaid by selectively rotating said sidewardly extending part to extend either in the direction toward said exercise area or in the opposite direction whereby one or the other of said arm portions swings over said exercise area.

2. Athletic exercise apparatus comprising a ground-supported base and a stationary upstanding post carried by and extending upwardly from said base, means defining an exercise area forwardly of and adjoining said post, an exercise arm, means supported by said post and providing a pivot for said arm having its axis extending in a direction transverse with respect to the longitudinal axis of said post so that said arm may swing over said exercise area and is supported by said post, means restraining the swinging movement of said arm to provide exercise for the user when he moves said arm against said restraining means, and means for selectively adjusting the position of said pivot either backwardly away from or forwardly toward said exercise area so that said arm moves selectively more horizontally or more vertically over said exercise area during its exercising swinging movement, said arm including two arm portions on opposite sides of said pivot, said means for selectively adjusting the position of said pivot as aforesaid including a pipe journaled in said post and having its upper end bent to extend sidewardly with said pivot being supported by said upper end whereby said pivot may be moved as aforesaid by selectively rotating said upper end of said pipe to extend either in the direction toward said exercise area or in the opposite direction whereby one or the other of said arm portions swings over said exercise area.

3. Athletic exercise apparatus as set forth in claim 2 and including a cushion attached to said post just above and exercise area and below said bent portion of said pipe when it extends toward said exercise area.

4. Athletic exercise apparatus as set forth in claim 2 and including a cushion attached to said post just rearwardly of said exercise area and below said bent portion of said pipe, and a bench which is supported by said post beneath said cushion for supporting the back of a person straddling the bench.

5. Athletic exercise apparatus as set forth in claim 2 and including a second arm of the same shape as said first named arm and also supported by said pivot, handles on the ends of said arms remote from said pivot and attaching the ends of the arms together, a pair of auxiliary handles opposite each other on adjacent ones of said arm portions and another pair of auxiliary handles opposite each other on the other adjacent ones of said arm portions.

6. Athletic exercise apparatus as set forth in claim 2 and including a second arm of the same shape as said first named arm and also supported by said pivot, handles on the ends of said arms remote from said pivot and attaching the ends of the arms together, a pair of auxiliary handles opposite each other on adjacent ones of said arm portions and another pair of auxiliary handles opposite each other on the other adjacent ones of said arm portions, one pair of said auxiliary handles being in the form of balls.

7. Athletic exercise apparatus as set forth in claim 2 and including a second exercise arm which extends along parallel with said first-named exercise arm and has arm portions similar to said first-named arm portions and is pivoted by said pivot so that the arm portions of said two arms swing together, and handles connecting the ends of said arm portions together that are remote from said pivot.

8. Athletic exercise apparatus as set forth in claim 2, said means supported by said post and providing a pivot for said arm including an upstanding member fixed to the end of said pipe and carrying a shaft on its upper end for providing said pivot.

9. Athletic exercise apparatus as set forth in claim 8 and including a piston-cylinder assembly which is pivotally mounted on said upstanding member and has its piston connected by means of a piston rod with one of said arm portions.

10. Athletic exercise apparatus as set forth in claim 9 and including a second exercise arm which is substantially identical with said first-named exercise arm and is also pivoted on said pivot, and handles connecting the ends of said arm portions together.

* * * * *